US007010488B2

(12) United States Patent
van Santen et al.

(10) Patent No.: US 7,010,488 B2
(45) Date of Patent: Mar. 7, 2006

(54) SYSTEM AND METHOD FOR COMPRESSING CONCATENATIVE ACOUSTIC INVENTORIES FOR SPEECH SYNTHESIS

(75) Inventors: Jan P. H. van Santen, Lake Oswego, OR (US); Alexander Kain, Portland, OR (US)

(73) Assignee: Oregon Health & Science University, Portland, OR (US)

( * ) Notice: Subject to any disclaimer, the term of this patent is extended or adjusted under 35 U.S.C. 154(b) by 705 days.

(21) Appl. No.: 10/143,720

(22) Filed: May 9, 2002

(65) Prior Publication Data

US 2003/0212555 A1 Nov. 13, 2003

(51) Int. Cl.
*G10L 13/00* (2006.01)
*G10L 13/02* (2006.01)

(52) U.S. Cl. ..... 704/258; 704/265; 704/269

(58) Field of Classification Search ..... 704/241, 704/258, 260, 265, 266, 267, 269, 500, 501
See application file for complete search history.

(56) References Cited

U.S. PATENT DOCUMENTS

| | | | | |
|---|---|---|---|---|
| 5,165,008 | A * | 11/1992 | Hermansky et al. | 704/262 |
| 5,636,325 | A | 6/1997 | Farrett | 395/2.67 |
| 5,717,827 | A * | 2/1998 | Narayan | 704/260 |
| 5,740,320 | A | 4/1998 | Itoh | 395/2.76 |
| 5,751,907 | A * | 5/1998 | Moebius et al. | 704/267 |
| 5,758,023 | A | 5/1998 | Bordeaux | 395/2.41 |
| 5,790,978 | A | 8/1998 | Olive et al. | 704/207 |
| 5,845,238 | A | 12/1998 | Fredenburg | 704/1 |
| 6,064,960 | A | 5/2000 | Bellegarda et al. | 704/260 |
| 6,173,263 | B1 | 1/2001 | Conkie | 704/260 |
| 6,178,397 | B1 | 1/2001 | Fredenburg | 704/1 |
| 6,708,154 | B1 * | 3/2004 | Acero | 704/260 |
| 6,829,581 | B1 * | 12/2004 | Meron | 704/258 |
| 2003/0212555 | A1 * | 11/2003 | van Santen | 704/241 |
| 2004/0030555 | A1 * | 2/2004 | van Santen | 704/260 |
| 2005/0182629 | A1 * | 8/2005 | Coorman et al. | 704/266 |

OTHER PUBLICATIONS

Kain et al., "Compression of acoustic inventories using asynchronous interpolation," Proceedings of 2002 IEEE Workshop on Speech Synthesis, Sep. 11-13, 2002, pp. 83 to 86.*

J. Olive et al. "Multilingual Text-to-Speech Synthesis: The Bell Labs Approach, Synthesis." R. Sproat Ed., pp. 191-228 (Kluwer, Dordrecht. 1998).

M. Horne et al. "Computational Extraction of Lexico-Grammatical Information for generation of Swedish Intonation." Proceedings of the 2nd ESCA/IEEE workshop on Speech Synthesis, pp. 220-223, (New Paltz, New York. 1994).

(Continued)

*Primary Examiner*—Martin Lerner
(74) *Attorney, Agent, or Firm*—Darby & Darby

(57) ABSTRACT

A system and method is used to compress concatenative acoustic inventories for speech. Instead of using general purpose signal compression methods such as vector quantization, the method of the invention uses multiple properties of acoustic inventories to reduce the size of the acoustic inventories, such as the close acoustic match property and acoustic units that are labeled with sufficiently fine distinctions such that between any two phones no events occur that are substantially distinct from these two phones. The close acoustic match property is where acoustic units that share the same phone are acoustically similar at the points where these units may be concatenated. By utilizing multiple properties of acoustic units, the number of parameters per unit that are stored as LPC parameters are minimized. As a result, smaller storage devices may be used due to the reduction of the size of the storage requirements.

18 Claims, 7 Drawing Sheets

OTHER PUBLICATIONS

D. Yarowsky. "Homograph Disambiguation in Speech Synthesis." Proceedings of the $2_{nd}$ ESCA/IEEE workshop on Speech Synthesis, pp. 244-347, (New Paltz, New York. 1994).

J. van Santen, Assignment of Segmental Duration on Text-to-Speech Synthesis, Computer Speech and Language, vol. 8, pp. 95-128 (1994).

J. van Santen et al. "Segmental Effects on Timing and Height of Pitch Contours." Proceedings of the International Conference on Spoken language Processing, pp. 719-722 (Yokohama, Japan. 1994).

L. R. Rabiner and R. W. Schafer, Digital Processing of Speech Signals (Prentice-Hall, Inc., N.J., 1978).

J. Olive et al. Progress in Speech Synthesis, Chapter 7, Daelemans et al., "Language-Independent Data-Oriented Grapheme Conversion." pp. 77-79, (Springer New York 1996).

J. Olive et al., Progress in Speech Synthesis, Chapter 3, Oliveira, "Text-to-Speech Synthesis with Dynamic Control of Source Parameters." pp. 27-39, (Springer, New York, 1996).

* cited by examiner

SYSTEM AND METHOD FOR COMPRESSING CONCATENATIVE ACOUSTIC INVENTORIES FOR SPEECH SYNTHESIS

BACKGROUND OF THE INVENTION

1. Field of the Invention

The invention generally relates to the field of speech synthesis and, more particularly, to a system and method for compressing concatenative acoustic inventories for speech.

2. Description of the Related Art

Concatenative speech synthesis is used for various types of speech synthesis applications including text-to-speech and voice response systems. Most text-to-speech conversion systems convert an input text string into a corresponding string of linguistic units such as consonants and vowel phonemes, or phoneme variants such as allophones, diphones, or triphones. An allophone is a variant of the phoneme based on surrounding sounds. For example, the aspirated p of the word pawn and the unaspirated p of the word spawn are both allophones of the phoneme p. Phonemes are the basic building blocks of speech corresponding to the sounds of a particular language or dialect. Diphones and triphones are sequences of phonemes and are related to allophones in that the pronunciation of each of the phonemes depend on the other phonemes, diphones or triphones.

Diphone synthesis and acoustic unit selection synthesis (concatenative speech synthesis) are two categories of speech synthesis techniques which are frequently used today. Concatenative speech synthesis techniques involve concatenating diphone phonetic sequences obtained from recorded speech to form new words and sentences. Such concatenative synthesis uses actual pre-recorded speech to form a large database, or corpus which is segmented based on phonological features of a language. Commonly, the phonological features include transitions from one phoneme to at least one other phoneme. For instance, the phonemes can be segmented into diphone units, syllables or even words.

Diphone concatenation systems are particularly prominent. A diphone is an acoustic unit which extends from the middle of one phoneme to the middle of the next phoneme. In other words, the diphone includes the transition between each partial phoneme. It is generally believed that synthesis using concatenation of diphones provides a reproduced voice of high quality, since each diphone is concatenated with adjoining diphones at the point where the beginning and the ending phonemes have reached steady state, and since each diphone records the actual transition from phoneme to phoneme.

In diphone synthesis, a diphone is defined as the second half of one phoneme followed by the initial half of the following phoneme. At the cost of having N.times.N (capital N being the number of phonemes in a language or dialect) speech recordings, i.e., diphones in a database, high quality synthesis can be achieved. For example, in English, N would equal between 40–45 phonemes depending on regional accents and the definition of the phoneme set. An appropriate sequence of diphones is concatenated into one continuous signal using a variety of techniques (e.g., time-domain Pitch Synchronous Overlap and Add (TD-PSOLA)).

This approach does not, however, completely solve the problem of providing smooth concatenations, nor does it solve the problem of generating synthetic speech which sounds natural. Generally, there is some spectral envelope mismatch at the concatenation boundaries. For severe cases, depending on how the signals are treated, a speech signal may exhibit glitches, or degradation in the clarity of the speech signal may occur. Consequently, a great deal of effort is often expended to choose appropriate diphone units that will not possess such defects, irrespective of which other units they are matched with. Thus, in general, a considerable effort is devoted to preparing a diphone set and selecting sequences that are suitable for recording and to verifying that the recordings are suitable for the diphone set.

In addition to the foregoing problems, other significant problems exist in conventional diphone concatenation systems. In order to achieve a suitable concatenation system, a minimum of 1500 to 2000 individual diphones must be used. When segmented from pre-recorded continuous speech, suitable diphones may be unobtainable because many phonemes (where concatenation is to take place) have not reached a steady state. Thus, a mismatch or distortion can occur from phoneme to phoneme at the point where the diphones are concatenated together. To reduce this distortion, conventional diphone concatenative synthesizers, as well as others, often select their units from carrier sentences or monotone speech and/or often perform spectral smoothing. As a result, a decrease in the naturalness of the speech can occur. Consequently, the synthesized speech may not resemble the original speech.

Another approach to concatenative synthesis is unit selection synthesis. Here, a very large database for recorded speech that has been segmented and labeled with prosodic and spectral characteristics is used, such as the fundamental frequency ($F_0$) for voiced speech, the energy or gain of the signal, and the spectral distribution of the signal (i.e., how much of the signal is present at any given frequency). The database contains multiple instances of phoneme sequences. This permits the possibility of having units in the database which are much less stylized than would occur in a diphone database where generally only one instance of any given diphone is assumed. As a result, the ability to achieve natural sounding speech is enhanced.

A key problem in either of the prior approaches is that acoustic units require a substantial storage space. This is true regardless of whether the acoustic units are obtained from a database during diphone synthesis or if the acoustic units are permitted to remain in an actual database during concatenative synthesis.

SUMMARY OF THE INVENTION

The invention is a system and method for compressing concatenative acoustic inventories for speech synthesis. Instead of using general purpose signal compression methods such as vector quantization, the method of the invention uses multiple properties of acoustic inventories to reduce the size of the acoustic inventories, such as the close acoustic match property and acoustic units that are labeled with sufficiently fine distinctions such that between any two phones no events occur that are substantially distinct from these two phones. The close acoustic match property is where acoustic units that share the same phone are acoustically similar at the points where these units may be concatenated. By utilizing multiple properties of acoustic units, the number of parameters per unit that are stored as LPC parameters are minimized. As a result, smaller storage devices may be used due to the reduction of the size of the storage requirements.

In accordance with the invention, a sequence of acoustic vectors (or a trajectory) that comprise an acoustic unit is approximated by a mathematical interpolation between a small number of basis acoustic parameter vectors that are shared among acoustic units. Here, the total number of basis acoustic parameter vectors is not substantially larger than the number of phonemes in a language, and the interpolation is characterized using a small number of parameters. As a result, each diphone is stored in the form of the minimally sized parameter characterization, and the only additionally required storage space is for the small number of basis acoustic parameter vectors.

In accordance with a preferred embodiments, during estimation of parameter values that characterize the mathematical interpolations to best fit the trajectories, the parameter values are restricted to ensure that the decompressed acoustic units perfectly satisfy the close acoustic match property. As a result, the overall smoothness of the synthesizer output speech is enhanced. In preferred embodiments, the mathematical interpolation is non-linear, and represents an acoustic unit as a sequence of vectors that morph an initial basis vector for the acoustic unit into a final basis vector for the unit.

BRIEF DESCRIPTION OF THE DRAWINGS

The foregoing and other advantages and features of the invention will become more apparent from the detailed description of the preferred embodiments of the invention given below with reference to the accompanying drawings in which.

DETAILED DESCRIPTION OF THE EXEMPLARY EMBODIMENTS

Figure 1:
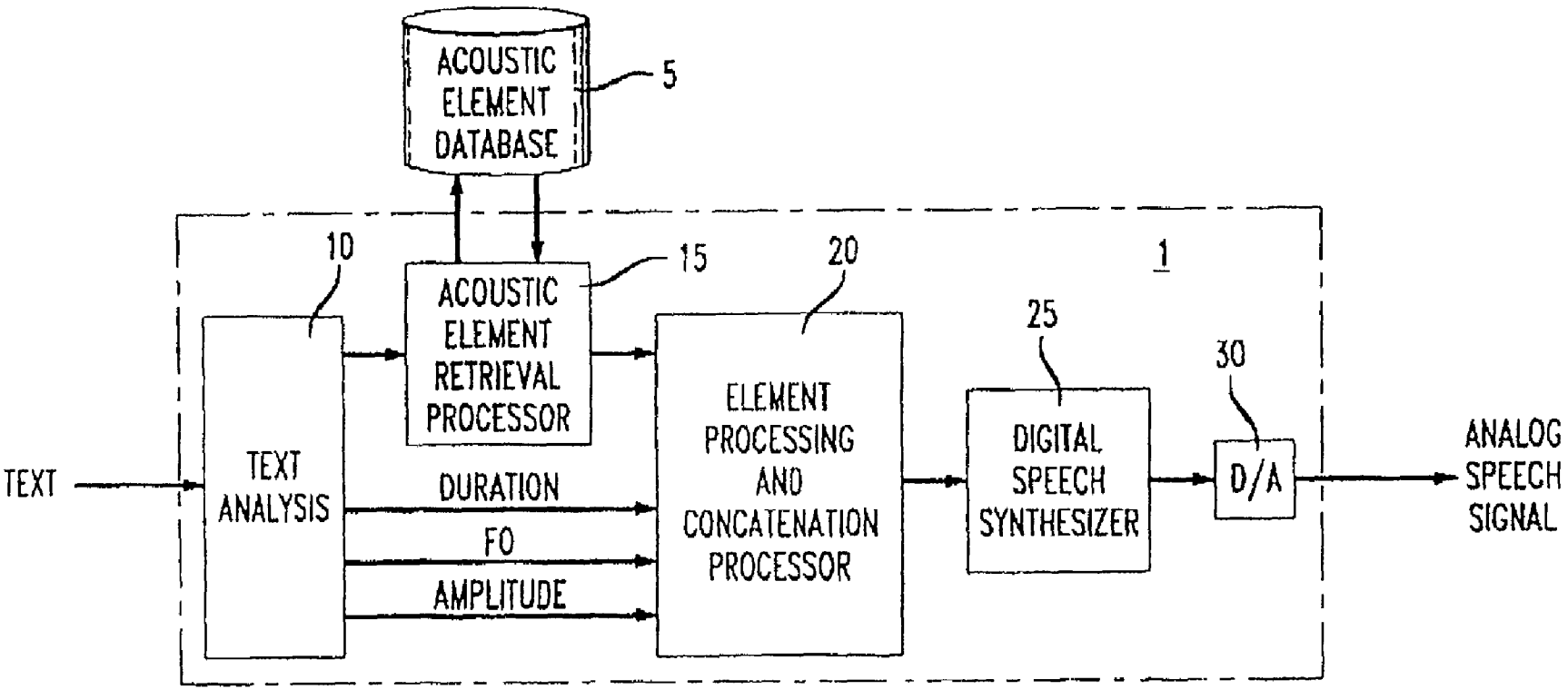
FIG. 1 is an illustration of a schematic block diagram of an exemplary text-to-speech synthesizer employing an acoustic element database in accordance with the present invention.

An exemplary text-to-speech synthesizer 1 for compressing concatenative acoustic inventories in accordance with the present invention is shown in FIG. 1. For clarity, functional components of the text-to-speech synthesizer 1 are represented by boxes in FIG. 1. The functions executed in these boxes can be provided through the use of either shared or dedicated hardware including, but not limited to, application specific integrated circuits, or a processor or multiple processors executing software. Use of the term processor and forms thereof should not be construed to refer exclusively to hardware capable of executing software and can be respective software routines performing the corresponding functions and communicating with one another.

In FIG. 1, it is possible for the database 5 to reside on a storage medium such as computer readable memory including, for example, a CD-ROM, floppy disk, hard disk, read-only-memory (ROM) and random-access-memory (RAM). The database 5 contains acoustic elements corresponding to different phoneme sequences or polyphones including allophones.

In order for the database 5 to be of modest size, the acoustic elements should generally correspond to a limited sequences of phonemes, such as one to three phonemes. The acoustic elements are phonetic sequences that start in the substantially steady-state center of one phoneme and ends in the steady-state center of another phoneme. It is possible to store the acoustic elements in the database 5 in the form of linear predictive coder (LPC) parameters or digitized speech which are described in detail in, for example, J. Olive et al. Multilingual Text-to-Speech Synthesis "The Bell Labs Approach, Synthesis." R. Sproat Ed., pgs. 191–228 (Kluwer, Dordrecht. 1998), which is incorporated by reference herein.

The text-to-speech synthesizer 1 includes a text analyzer 10, acoustic element retrieval processor 15, element processing and concatenation (EPC) processor 20, digital speech synthesizer 25 and digital-to-analog (D/A) converter 30. The text analyzer 10 receives text in a readable format, such as ASCII format, and parses the text into words and further converts abbreviations and numbers into words. The words are then separated into phoneme sequences based on the available acoustic elements in the database 5. These phoneme sequences are then communicated to the acoustic element retrieval processor 15.

Exemplary methods for the parsing of words into phoneme sequences and the abbreviation and number expansion are described in J. Olive et al. Progress in Speech Synthesis, Chapter 7, Daelemans et al., "Language-Independent Data-Oriented Grapheme Conversion." pgs 77–79, (Springer N.Y. 1996); M. Horne et al. "Computational Extraction of Lexico-Grammatical Information for generation of Swedish Intonation." Proceedings of the 2$^{nd}$ ESCA/IEEE workshop on Speech Synthesis, pgs. 220–223, (New Paltz, N.Y. 1994); and in D. Yarowsky. "Homograph Disambiguation in Speech Synthesis." Proceedings of the 2$^{nd}$ ESCA/IEEE workshop on Speech Synthesis, pgs. 244–247, (New Paltz, N.Y. 1994), all of which are incorporated by reference herein.

The text analyzer 10 further determines the duration, amplitude and fundamental frequency of each of the phoneme sequences and communicates such information to the EPC processor 20. Exemplary methods for determining the duration of a phoneme sequence include those described in J. van Santen "Assignment of Segmental Duration in Text-to-Speech Synthesis, Computer Speech and Language." Vol. 8, pp. 95–128 (1994), which is incorporated by reference herein. Exemplary methods for determining the amplitude of a phoneme sequence are described in J. Olive et al., Progress in Speech Synthesis, Chapter 3, Oliveria, "Text-to-Speech Synthesis with Dynamic Control of Source Parameters." pgs. 27–39, (Springer, N.Y. 1996), which is also incorporated by reference herein. The fundamental frequency of a phoneme is alternatively referred to as the pitch or intonation of segment. Exemplary methods for determining the fundamental frequency or pitch of a phoneme are described in J. van Santen et al. "Segmental Effects on Timing and Height of Pitch Contours." Proceedings of the International Conference on Spoken language Processing, pgs. 719–722 (Yokohama, Japan. 1994), which is further incorporated by reference herein.

The acoustic element retrieval processor 15 receives the phoneme sequences from the text analyzer 10 and then selects and retrieves the corresponding proper acoustic element from the database 5. Exemplary methods for selecting acoustic elements are described in the above cited Oliveira reference. The retrieved acoustic elements are then communicated by the acoustic element retrieval processor 15 to the EPC processor 20. The EPC processor 20 modifies each of the received acoustic elements by adjusting their fundamental frequency and amplitude, and inserting the proper duration based on the corresponding information received from the text analyzer 10. The EPC processor 20 then concatenates the modified acoustic elements into a string of acoustic elements corresponding to the text input of the text analyzer 10. Methods of concatenation for the EPC processor 20 are described in the above cited Oliveira article.

The string of acoustic elements generated by the EPC processor 20 is provided to the digital speech synthesizer 25 which produces digital signals corresponding to natural speech of the acoustic element string. Exemplary methods of digital speech synthesis are also described in the above cited Oliveira article. The digital signals produced by the digital speech synthesizer 25 are provided to the D/A converter 30 which generates corresponding analog signals. Such analog signals can be provided to an amplifier and loudspeaker (not shown) to produce natural sounding synthesized speech.

Figure 2A:
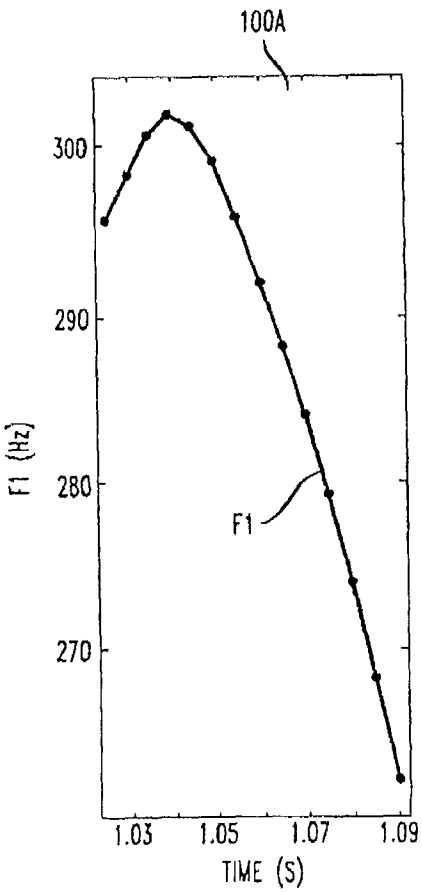
FIGS. 2(*a*) thru 2(*c*) illustrate speech spectrograms of exemplary formants of a phonetic segment.
Figure 2B:
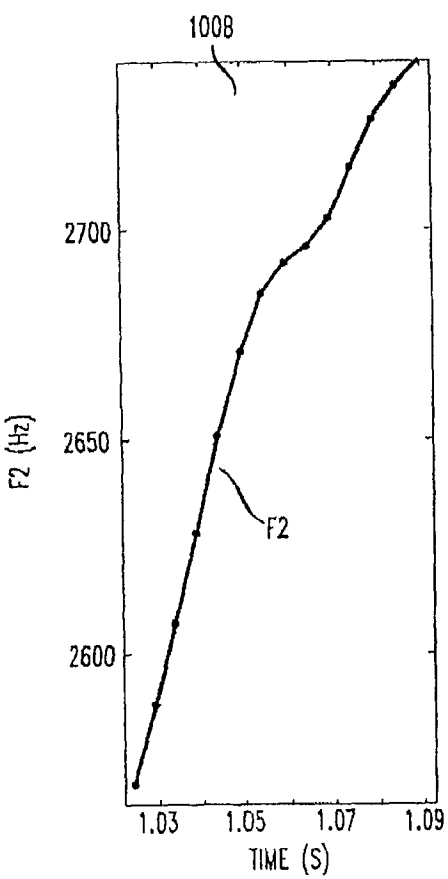
Figure 2C:
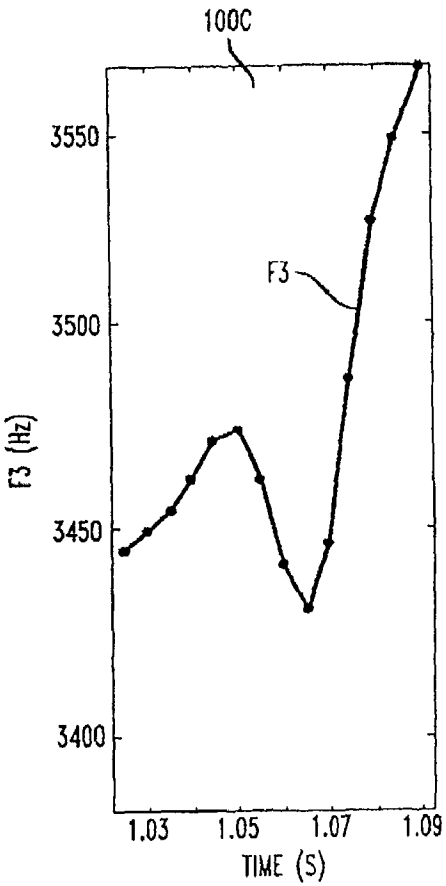

A characteristics of phonetic sequences over time can be represented in several representations including formants, amplitude and any spectral representations including ceptral representations or any LPC derived parameters. FIGS. 2A–2C show speech spectrograms 100A, 100B and 100C of different formant frequencies or formants F1, F2 and F3 for a phonetic segment corresponding to the phoneme /i/ taken from recorded speech of a phoneme sequence /p-i/. The formants F1–F3 are trajectories that depict the different measured resonance frequencies of the vocal tract of the human speaker. Formants for the different measured resonance frequencies are typically named F1, F2, . . . $F_N$, based on the spectral energy that is contained by the respective formants.

Formant frequencies depend upon the shape and dimensions of the vocal tract. Different sounds are formed by varying the shape of the vocal tract. Thus, the spectral properties of the speech signal vary with time as the vocal tract shape varies during the utterance of the phoneme segment /i/ as is depicted in FIGS. 2A–C. The three formants F1, F2 and F3 are depicted for the phoneme /i/ for illustration purposes only. It should be understood that different numbers of formants can exist based on the shape of the vocal tract for a particular speech segment. A more detailed description of formants and other representations of speech is provided in L. R. Rabiner and R. W. Schafer, Digital Processing of Speech Signals (Prentice-Hall, Inc., N.J., 1978), which is incorporated by reference herein.

Figure 3:
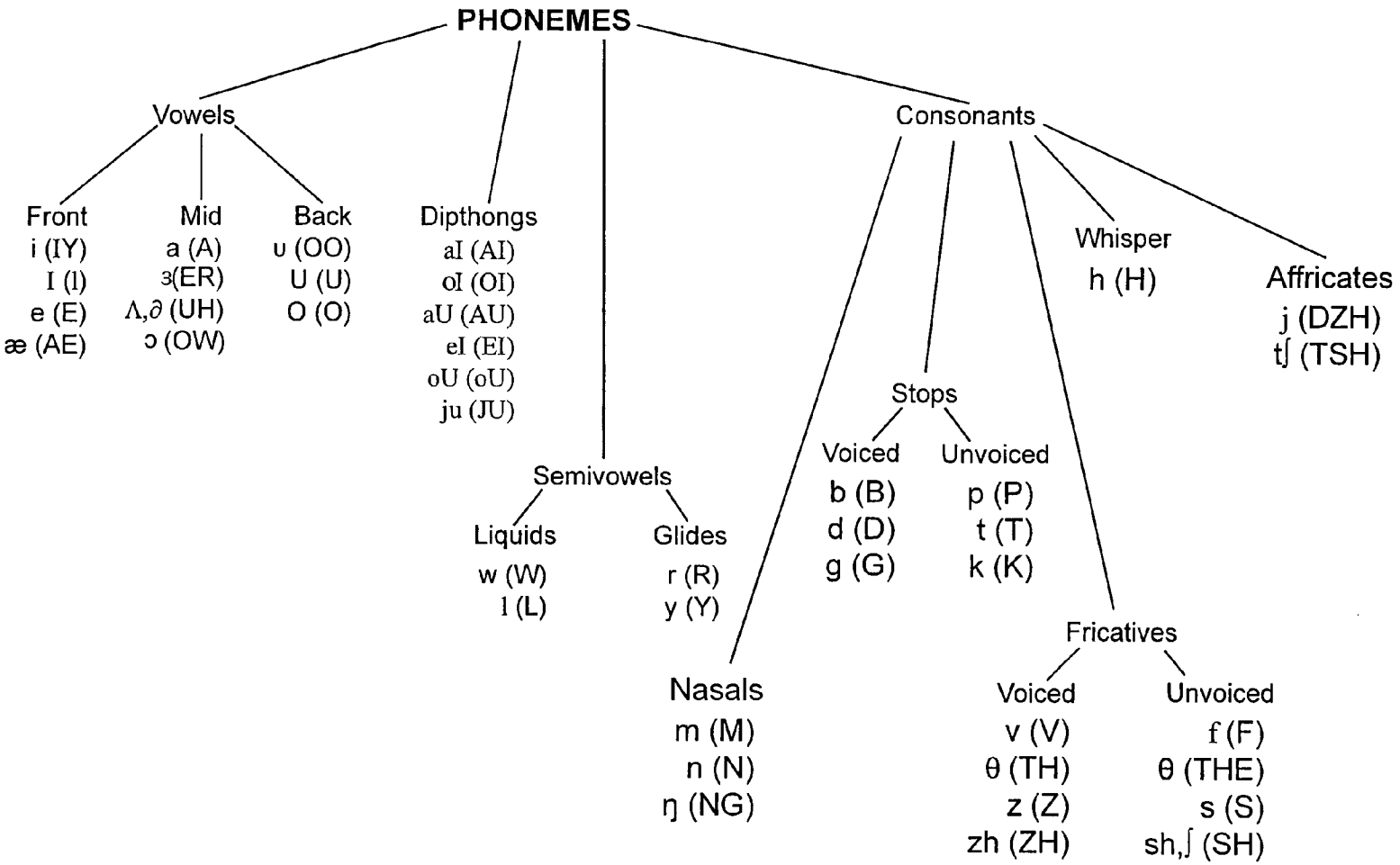
FIG. 3 is a phonetic and an orthographic illustration of classes for each phoneme within the English language.

Typically, the sounds of the English language are broken down into phoneme classes, as shown in FIG. 3. The four broad classes of sound are vowels, diphthongs, semivowels, and constants. Each of these classes may be further broken down into sub-classes related to the manner, and place of articulation of the sound within the vocal tract.

Each of the phoneme classes in FIG. 3 can be classified as either a continuant or a non-continuant sound. Continuant sounds are produced by a fixed (on-time varying) vocal tract configuration excited by an appropriate source. The class of continuant sounds includes the vowels, fricatives (both voiced and unvoiced), and the nasals. The remaining sounds (dipthongs, semivowels stops and affricates) are produced by a changing vocal tract configuration. These are therefore classed as non-continuants.

Vowels are produced by exciting a fixed vocal tract with quasi-periodic pulses of air caused by vibration of the vocal cords of a speaker. Generally, the way in which the cross-sectional area along the vocal tract varies determines the resonant frequencies of the tract (formants) and thus the sound that is produced. The dependence of cross-sectional area upon distance along the tract is called the area function of the vocal tract. The area function for a particular vowel is determined primarily by the position of the tongue, but the positions of the jaw, lips, and, to a small extent, the velum also influence the resulting sound. For example, in forming the vowel /a/ as in "father," the vocal tract is open at the front and somewhat constricted at the back by the main body of the tongue. In contrast, the vowel /i/ as in "eve" is formed by raising the tongue toward the palate, thus causing a constriction at the front and increasing the opening at the back of the vocal tract. Thus, each vowel sound can be characterized by the vocal tract configuration (area function) that is used in its production.

For the most part, a diphthong is a gliding monosyllabic speech item that starts at or near the articulatory position for one vowel and moves to or toward the position for another. In accordance with this, there are six diphthongs in American English including /eI/ (as in bay), /oU/ as in (boat), /aI/ (as in buy), /aU/ (as in how), /oI/ (as in boy) and /ju/ (as in you). Diphthongs are produced by smoothly varying the vocal tract between vowel configurations appropriate to the diphthong. In general, the diphthongs can be characterized by a time varying vocal tract area function which varies between two vowel configurations.

The group of sounds consisting of /w/, /1/, /r/, and /y/ are called semivowels because of their vowel-like nature. They are generally characterized by a gliding transition in a vocal tract area function between adjacent phonemes. Thus the acoustic characteristics of these sounds are strongly influenced by the context in which they occur. For purposes of the contemplated embodiments, the semi-vowels are transitional, vowel-like sounds, and hence are similar in nature to the vowels and diphthongs. The semi-vowels consist of liquids (e.g., w l) and glides (e.g., y r), as shown in FIG. 3.

The nasal consonants /m/, /n/, and /η/ are produced with glottal excitation and the vocal tract totally constricted at some point along the oral passageway. The velum is lowered so that air flows through the nasal tract, with sound being radiated at the nostrils. The oral cavity, although constricted toward the front, is still acoustically coupled to the pharynx. Thus, the mouth serves as a resonant cavity that traps acoustic energy at certain natural frequencies. For /m/, the constriction is at the lips; for /n/ the constriction is just back of the teeth; and for /η/ the constriction is just forward of the velum itself.

The voiceless fricatives /f/, /θ/, /s/ and /sh/ are produced by exciting the vocal tract with a steady air flow which becomes turbulent in the region of a constriction in the vocal tract. The location of the constriction serves to determine which fricative sound is produced. For the fricative /f/ the constriction is near the lips; for /θ/ it is near the teeth; for /s/ it is near the middle of the oral tract; and for /sh/ it is near the back of the oral tract. Thus, the system for producing voiceless fricatives consists of a source of noise at a constriction, which separates the vocal tract into two cavities. Sound is radiated from the lips, i.e., from the front cavity of the mouth. The back cavity serves, as in the case of nasals, to trap energy and thereby introduce anti-resonances into the vocal output.

The voiced fricatives /v/, /th/, /z/ and /zh/ are the respective counterparts of the unvoiced fricatives /f/, /θ/, /sl/, and /sh/, in that the place of constriction for each of the corresponding phonemes is essentially identical. However, voiced fricatives differ markedly from their unvoiced counterparts in that two excitation sources are involved in their production. For voiced fricatives the vocal cords are vibrating, and thus one excitation source is at the glottis. However, since the vocal tract is constricted at some point forward of the glottis, the air flow becomes turbulent in the neighborhood of the constriction.

The voiced stop consonants /b/, /d/ and /g/, are transient, non-continuant sounds which are produced by building up pressure behind a total constriction somewhere in the oral tract, and suddenly releasing the pressure. For /b/ the constriction is at the lips; for /d/ the constriction is back of the teeth; and for /g/ it is near the velum. During the period when there is a total constriction in the tract no sound is radiated from the lips. However, there is often a small amount of low frequency energy which is radiated through the walls of the throat (sometimes called a voice bar). This occurs when the vocal cords are able to vibrate even though the vocal tract is closed at some point.

The voiceless stop consonants /p/, /t/ and /k/ are similar to their voiced counterparts /b/, /d/, and /g/ with one major exception. During the period of total closure of the vocal tract, as the pressure builds up, the vocal cords do not vibrate. Thus, following the period of closure, as the air pressure is released, there is a brief interval of friction (due to sudden turbulence of the escaping air) followed by a period of aspiration (steady air flow from the glottis exciting the resonances of the vocal tract) before voiced excitation begins.

The remaining consonants of American English are the affricates /tʃ/ and /j/ and the phoneme /h/. The voiceless affricate /tʃ/ is a dynamical sound which can be modeled as the concatenation of the stop /t/ and the fricative /ʃ/. The voiced affricate /j/ can be modeled as the concatenation of the stop /d/ and the fricative /zh/. Finally, the phoneme /h/ is produced by exciting the vocal tract by a steady air flow, i.e., without the vocal cords vibrating, but with turbulent flow being produced at the glottis. Of note, this is also the mode of excitation of whispered speech. The characteristics of /h/ are invariably those of the vowel which follows /h/ since the vocal tract assumes the position for the following vowel during the production of /h/. See, e.g., L. R. Rabiner and R. W. Schafer, Digital Processing of Speech Signals (Prentice-Hall, Inc., N.J., 1978).

Many conventional speech synthesis systems utilize an acoustic inventory, i.e., a collection of intervals of recorded natural speech (e.g., acoustic units). These intervals correspond to phoneme sequences, where the phonemes are optionally marked for certain phonemic or prosodic environments. In embodiments of the invention, a phone is a marked or unmarked phoneme. Examples of such acoustic units include the /e/-/p/ unit (as in the words step or repudiate; in this unit, the constituent phones are not marked), the unstressed-/e/-stressed-/p/ unit (as in the word repudiate; both phones are marked for stress), or the final-/e/-final-/p/ unit (as in at the end of the phrase "He took one step;" both phones are marked since they occur in the final syllable of a sentence.) During synthesis, an algorithm is used to retrieve the appropriate sequence of units and concatenate them together to generate the output speech.

A critical factor for high quality voice synthesis is that the acoustic units must be defined and created in such a way that any two acoustic units, because they share a phone, can be concatenated to provide for a smooth transition between the two acoustic units. For example, the /b/-/e/ and /e/-/t/ units should be acoustically as similar, in terms of the acoustic features of the final part of the first unit and the initial part of the second unit. In fact, it is a hallmark of optimum acoustic inventory design and creation that these close matches are guaranteed. See, e. g., J. Olive et al. "Multilingual Text-to-Speech Synthesis: The Bell Labs Approach, Synthesis." R. Sproat Ed., pgs. 191–228 (Kluwer, Dordrecht. 1998).

In certain instances, brief acoustic events occur in transitions between two phones that are spectrally dissimilar to both phones. Examples include epenthetic stops, i.e., phonemes which are created by the interaction between two other phonemes, such as the /s/-/n/ transition, where a silent interval occurs in the boundary region; this silence is spectrally dissimilar to the /s/-/n/ boundary region. Alternatively, a brief vowel-like interval may be produced in the /s/-/n/ boundary region. Again, this sound is spectrally similar neither to /s/ nor to /n/. In accordance with the invention, phone labeling is used to construct acoustic unit inventories which are sufficiently fined-grained such that the acoustic sounds are explicitly labeled. In preferred embodiments of the invention, the /s/-/n/ unit is re-labeled as /s/-/*/-/n/ (where /*/ denotes silence) or as /s/ /&/-/n/ (where /&/ denotes a brief vowel like sound).

In accordance with the invention, the acoustic units are stored in the form of trajectories in an acoustic parameter space, such as linear predictive coding (LPC) coefficients. For example, the trajectory for the /e/-/p/ unit consisting of $n_{/e/-/p/}$ successive vectors is represented as:

$$v[t;\ /e/-/p/],\ \text{where } t=1,2,\ldots,n_{/e/-/p/}, \qquad \text{Eq. 1}$$

where t is a unit of time.

For speech synthesis, each trajectory comprising several thousand acoustic units must be stored. In accordance with the invention, a highly efficient method of representing these trajectories, which capitalizes on close acoustic matching of the terminal frames of the original acoustic unit, is used to thereby enable compression of the acoustic units. Typically, a 12-th order representation of LPC parameters in a diphone system, where each diphone has a duration of 100 ms and has an LPC vector and an energy parameter every 10 ms (and thus ten 13-element LPC+energy vectors), and where the total number of diphones is 1600 (based on an alphabet of 40 phones), requires storing 13*10*1,600=208,000 parameters. In preferred embodiments of the invention, however, the trajectory for a given diphone is a mathematical combination of a small set of basis acoustic parameter vectors. In certain embodiments, vectors in the trajectory are approximated via two time varying weights, such as 2 parameter S-shaped functions, where the weight functions are applied to the basis vectors which correspond to the first phoneme and the second phoneme, respectively. In this case, only 13*40+2*2*1600=6,920 parameters are needed to synthesize original speech. As a result, a substantial compression of the acoustics units is achieved.

When acoustic units in an acoustic inventory are acoustically closely matched, trajectories for the acoustic units which begin or end on the same phone will terminate at points in a vector space which are close to a point which represents the shared phone. As a result, the terminal frames will be close to each other in the vector space. These points represent shared phones and are called basis vectors. By representing each vector in the trajectory as a weighted combination of the basis vectors, an approximate representation of all trajectories as a function of the basis vectors is achieved. Moreover, for a specific trajectory, the approximation only utilizes the basis vectors associated with a sequence of phones for a particular acoustic unit. In other words, the basis vector for /n/ to describe the /e/-/p/ trajectory is not needed, only the basis vectors for /e/ and /p/.

Figure 4:
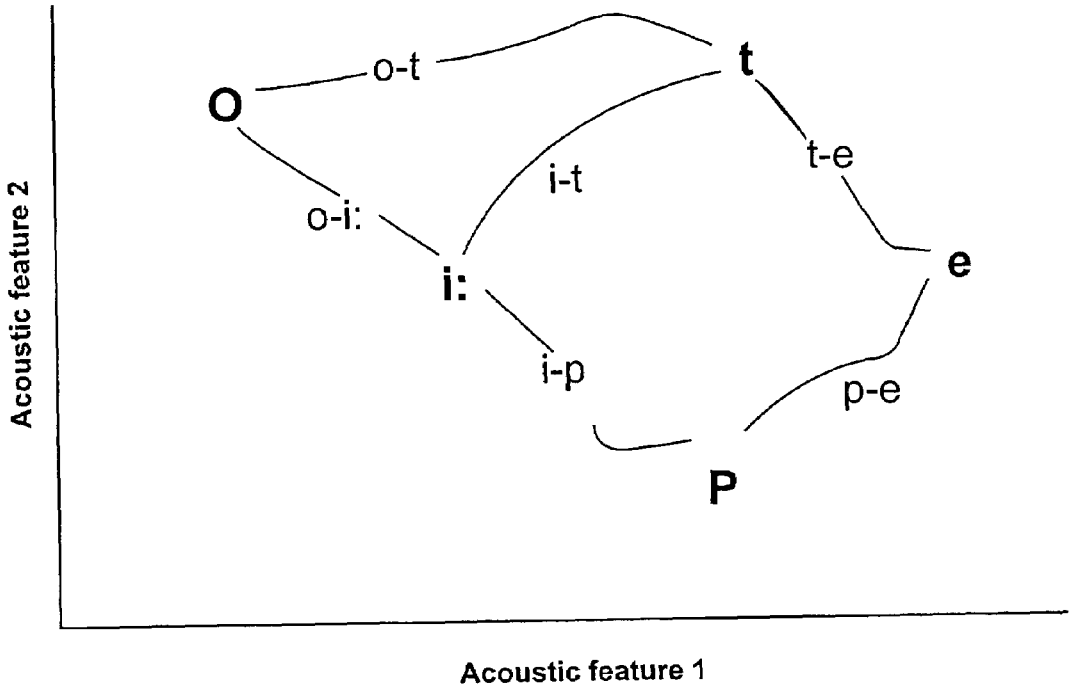
FIG. 4 is an exemplary plot of acoustic trajectories which illustrate a close acoustic match property and the role of basis vectors.

FIG. 4 is an exemplary plot of acoustic trajectories which illustrate the close acoustic match property and the role of basis vectors. For simplicity, a 2-dimensional vector is shown. However, other embodiments with vectors having a larger number of dimensions may be used, such as LPC vectors possessing at least 8 dimensions.

In FIG. 4 several basis vectors are shown. Here, the basis vectors o, i:, t, p and e are denoted in bold. The trajectories of the acoustic units are shown as curves (o-t, o-i:, i:-t, t-e, i:-p and p-e) which approximately connect the phone target vectors.

A vector at time t is approximated in accordance with the parameterized vector relationship:

$$v[t;\ /e/\text{-}/p/] \approx w(t;\ /e/\text{-}/p/,\ /e/) * v[/e/] + w(t;\ /e/\text{-}/p/,\ /p/) * v[/p/], \qquad \text{Eq. 2}$$

where the basis vectors associated with the phone /e/ and /p/ are $$v[/e/] \text{ and } v[/p/], \text{ and} \qquad \text{Eq. 3}$$

the trajectory v[t; /e/-/p/] is approximated using two time-varying weights, or weight functions in accordance with the relationship:

$$w(t;\ /e/\text{-}/p/,\ /e/) \text{ and } w(t;\ /e/\text{-}/p/,\ /p/). \qquad \text{Eq. 4}$$

To synthesize speech, a table is required for storing LPC parameter values associated with the speech vectors (i.e., a vector space). In accordance with the invention, this vector space is minimized by removing the number of parameters which are stored in the table. That is, for each acoustic unit, only the parameters which characterize the time-varying weights are stored in the table. The basis vectors used for each acoustic unit are retrieved from the table based on the phoneme labels of the acoustic unit, and are not stored with the acoustic unit because they are common to many acoustic units. This permits a reduction of the size of storage devices due to the reduction of storage requirements. As a result, the ability to provide speech synthesis in a variety of smaller products, such as a Personal Digital Assistant (PDA), a watch, a cellular phone or the like, is achieved.

Figure 5:
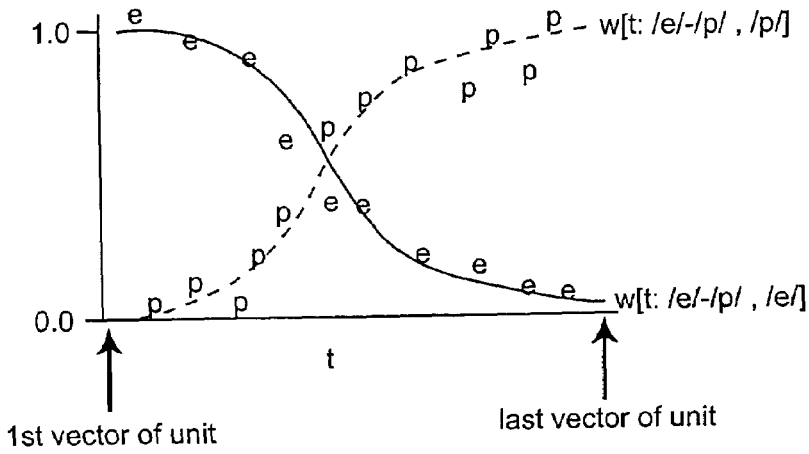
FIG. 5 is an illustration of hypothetical values of the weight functions in accordance with the invention.

FIG. 5 is an illustration of hypothetical values of the weight functions of Eq. 2 in accordance with the invention. Here, the functions are shown as points labeled e for w(t; [/e/-/p/, /e/)] and p [for w(t; /e/-/p/, /p/)]. The points are estimated to optimize the "fit" by way of a least-squares fit between the actual trajectories and the trajectories created via Eq. 2. The curves are the best fitting approximation to these points, within the family of functions defined in Eq. 6. Generally, natural trajectories are smooth and well behaved, and hence these time-varying weights can be characterized by a small number of parameters. An example of only one parameter per target vector is a step function in accordance with the relationship:

$$w(t;\ /e/\text{-}/p/,\ /e/) = 1, \text{ for } t < t(/e/\text{-}/p/, /e/), \text{ and 0 otherwise.} \qquad \text{Eq. 5}$$

On the other hand, an example of only two parameters per target vector is an inverse S-shaped function in accordance with the relationship:

$$w(t;\ /e/\text{-}/p/,\ /e/) = 1 - 1/[1 - e^{(-s(/e/\text{-}/p/,/e/)*(t-m(/e/\text{-}/p/,/e/)))}], \qquad \text{Eq. 6}$$

where s(/e/-/p/,/e/) is the slope of the function and m(/e/-/p/,/e/) is the location of the function on a time axis).

The relationships in Eq. 7 and Eq. 8 may be used to obtain a compression ratio of an acoustic inventory. The functions shown in FIG. 5 are approximations to the e and p points. In accordance with the invention, an imposition of the constraints $$w(t_{first};\ /e/\text{-}/x/,\ /e/) = w(t_{last};\ /x/\text{-}/e/,\ /e/) = w[/e/] \text{ for all phones } x \qquad \text{Eq. 7}$$

and $$w(t_{first};\ /e/\text{-}/x/,\ /x/) = w(t_{last};\ /x/\text{-}/e/,\ /x/) = w[/e/] \text{ for all phones } x \qquad \text{Eq. 8}$$

guarantees that synthesized trajectories are spectrally smooth around points of concatenation, because the units on both sides of the concatenation point will be acoustically identical. (In Eqs. 7 and 8, $t_{first}$ is the first frame of a trajectory and $t_{last}$ is the last frame of the trajectory.)

In accordance with the invention, stored trajectories for the same phone are modeled as common target vectors and the trajectories are concatenated at these points. In this case, the resultant spectral features will be identical on both sides of a concatenation point. As a result, an exceptional level of smoothness is obtained.

In accordance with the preferred embodiment of the invention, a non-linear mathematical combination is used to represent the set of basis acoustic parameter vectors. Here, the basis vectors are spectral amplitude contours having indices and values which respectively correspond to specific frequencies and amplitudes of the local speech wave at the specific frequencies. Generally, peaks in the contours correspond to formant frequencies. In addition, indices which correspond to a fixed drop in amplitude relative to the peak amplitude are located on either side of the peaks. When viewed on a frequency axis, the spacing of such "flanking" indices reflect the bandwidth of the formants. The indices (or, equivalently, frequencies) which correspond to peaks and flanking indices are alignment indices. Each basis vector possesses n alignment indices.

Figure 6:
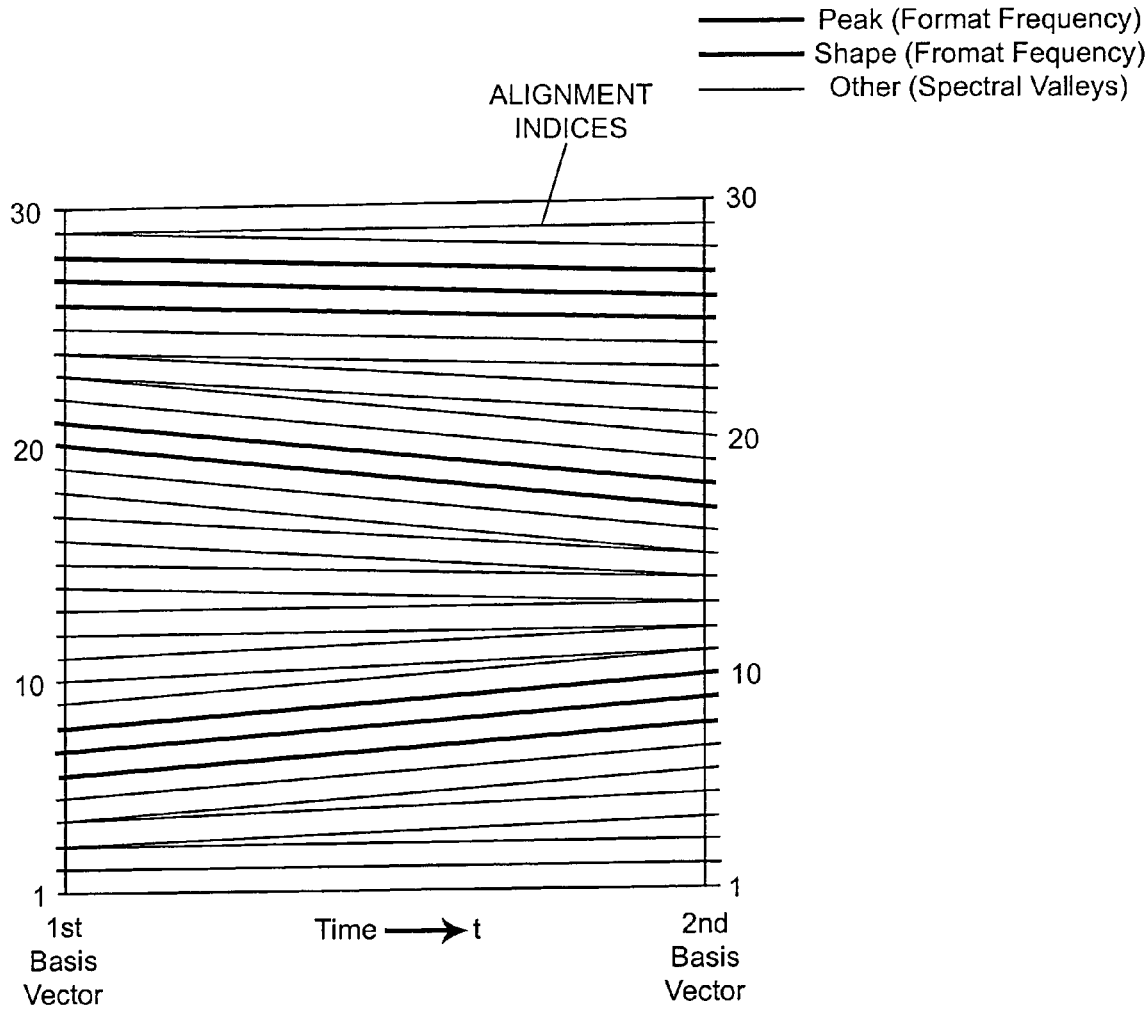
FIG. 6 is an exemplary graphical plot of indices of basis vectors in accordance wit the invention.

FIG. 6 is an exemplary graphical plot of indices of basis vectors in accordance with the invention. The indices of a first and a second basis vector of an acoustic unit are shown on the left and right side of the graph, respectively. The horizontal axis is the time axis, in arbitrary units. In accordance with the preferred embodiment, for any pair of basis vectors x and y, a correspondence between the alignment indices of the two basis vectors is first determined. Next, a correspondence between the remaining indices is created by linearly interpolating between successive corresponding alignment indices. Here, each correspondence is represented as straight lines which connect indexes in the first basis vector with the corresponding index in the second basis vector. In the preferred embodiment, the correspondence between the alignment indices of the two basis vectors is a one-to-one correspondence.

At any location on the time axis, a correspondence between the indices at this location and the indices in the basis vectors may be obtained by noting the intersection of these lines with a vertical line (not shown) that "extends" through and intersects the location on the time axis, i.e., a computed index may be obtained. Based on the computed index, the amplitude of the vector at this location may be defined as the linear combination of the amplitudes at the corresponding indices of the basis vectors, where the weights are given by t/T and (T-t)/T. In the preferred embodiments, the specific instant in time is t and T is the total time interval between the first and second basis vectors shown in FIG. 6. At this juncture, a new spectral amplitude counter is achieved at time t. In the preferred embodiment, the method is performed at any given time, where t=0, 1, . . . , T. As a result, a sequence approximation vectors V(0), . . . , V(T) is created. Naturally, it will be appreciated that V(0)=x and V(T)=y. In this sequence, the vectors gradually "morph" x into y in accordance with the preferred embodiment. For example, given the /x-y/ diphone comprising K vectors, for any instant in time t within the sequence of vectors v(0), . . , v(K) representing the /x-y/ diphone, t' in the interval (0, T) is obtained such that v(t) is closest to V(t'). As a result, a time warp k(n) that maps {0, . . . , K} onto {0, . . . , T} is achieved. In the present embodiment, the time warp is achieved by interpolating between a small number of points (t, t'). In this case, parameters of the functions that approximate points (t, t') are the sole parameters that are stored to represent each diphone. In addition, the parameters which characterize the time warps are shared by acoustic units belonging to the same phoneme class.

As stated previously, the parameters which characterize the time warps are shared by acoustic units belonging to the same phoneme class. In accordance with the preferred embodiment, the phoneme classes are: voiced fricatives, voiceless fricatives, voiced stops, voiceless stops, affricates, nasals, liquids, glides, vowels, diphthongs and h. (Of note, these classes may vary depending on the phoneme labeling scheme and the language used.)

The class of a unit is defined as the sequence of class labels of its constituent phones. Thus, n-o is represented as <nasal, vowel>. The parameters characterizing these time warps for each unit class are stored in memory. At run time, a diphone is accessed and the parameters are retrieved via the corresponding unit class. In preferred embodiments, the number of unit classes is 121, which is substantially less than the number of diphones (see, e.g., L. R. Rabiner and R. W. Schafer discussed previously).

Figure 7A:
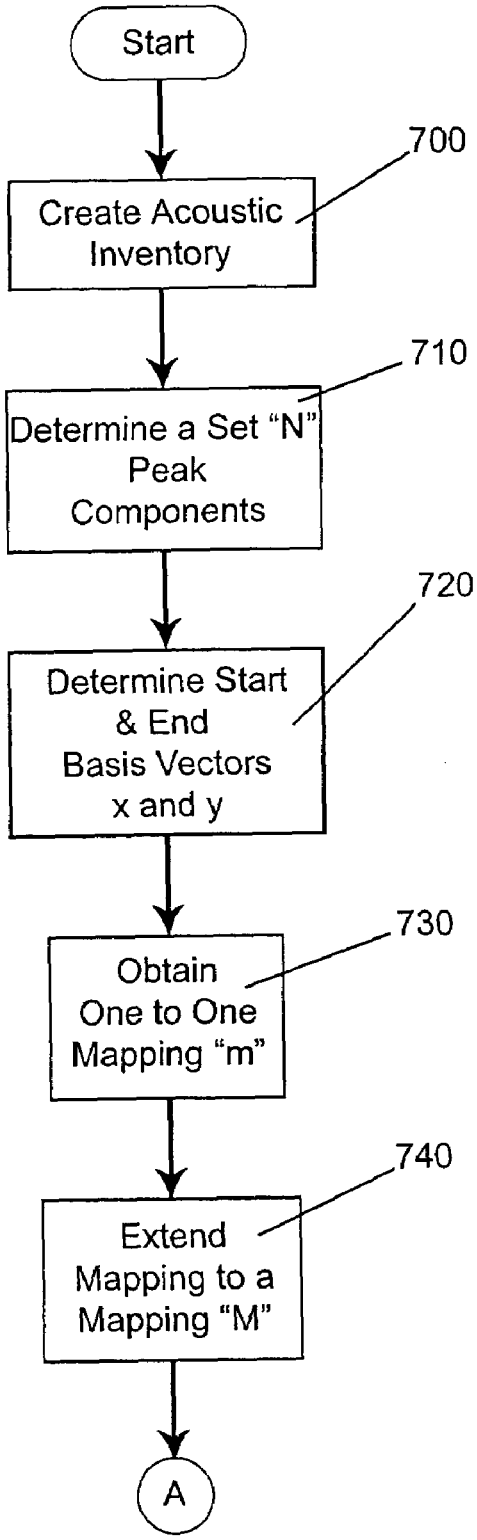
FIGS. 7(*a*) and 7(*b*) are flow charts illustrating the steps of the method of the invention in accordance with the preferred embodiment.
Figure 7B:
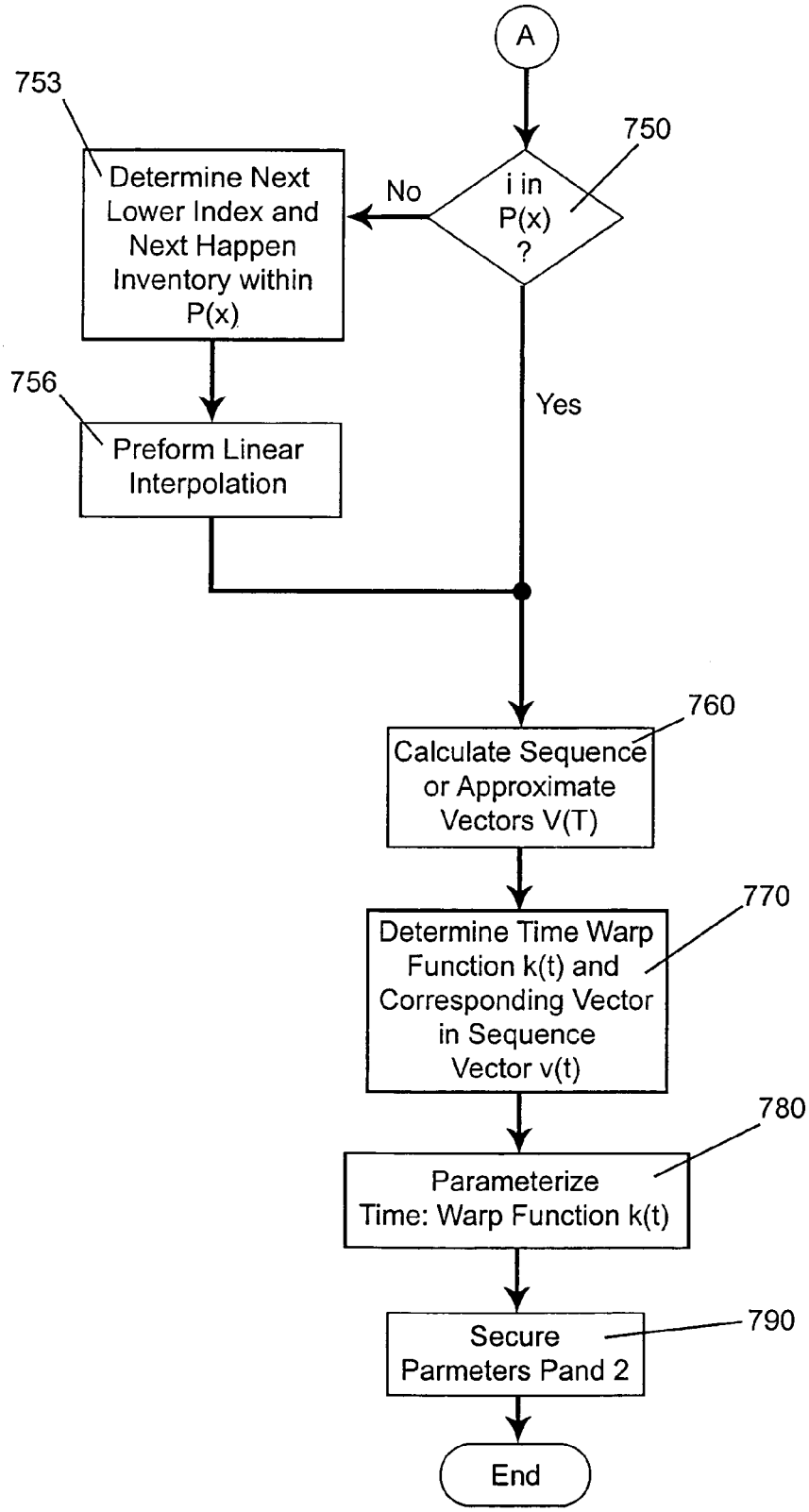

FIG. 7 is a flow chart illustrating the steps of the method of the invention in accordance with the preferred embodiment of the invention. In accordance with the preferred embodiment, the method of the invention is implemented by creating an acoustic inventory comprised of a plurality of natural speech intervals which are represented as sequences of vectors in vector space A, as indicated in step 700. Here, A is an acoustic space. In the preferred embodiment, vector space A comprises 128-point power spectra which are estimated in 20 ms wide Hamming windows. Each of these units are associated with phoneme sequences. Hence, a set of basis vectors b in vector space A is determined and labeled with the name of the corresponding phoneme or allophone.

For each basis vector b, a set of n peak components is determined, as indicated in step 710. The peak components each correspond to indices in the range of 1–128 which represent local peaks on a graph for displaying values of the components of b based on the number where the component occurs when viewing the spectral plot of the set of n peaks. In this case, P(b) are peak points associated with b such that a vector will have a total of 128 components on a horizontal axis Y, and each peak point will have an associated vector b at each of those 128 components. For each associated vector b, each index i in P(b) has an amplitude of b[i], where b[i] is the i-th component of b.

For each vector in each natural speech interval, start and end basis vectors based on two basis vectors x and y are determined, as indicated in step 720. Here, x and y are associated with the phonemes or allophones which are associated with a specific acoustic unit.

Next, a one-to-one mapping m from a first peak index set P(x) to a second peak index set P(y) is defined to thereby associate a peak point in P(y) with a peak point in P(x), as indicated in step 730. This mapping is then extended to a mapping M from the numbers {1, . . . , 128} to the numbers {1, . . . , 128}, as indicted in step 740.

A comparison between a complete morph mapping M(i) and a peak morph mapping m(i) is performed to determine whether an index i is located within the first peak index set P(x), as indicated in step 750. If the index i is not located within the first peak index set P(x), a next lower index I and a next higher index J that are both within the first peak index set P(x) are determined, as indicated in step 753. A linear interpolation between peak morph mapping values, m(I) and m(J), is then performed to obtain the complete morph mapping M(i), as indicated in step 756.

Next, a sequence of approximation vectors V(T) is created, as indicated in step 760. In the preferred embodiment, V(T) is computed in multiple stages in accordance with the relationships:

$$M_t[i]=(T-t)/T*i+t/T*M(i), \qquad \text{Eq. 9}$$

and $$V(T) \text{ whose } M_t[i]\text{-th component is } (T-t)/T*x[i]+t/T*y[M(i)], \qquad \text{Eq. 10}$$

where $M_t[i]$ is rounded to the nearest integer between 1 and 128, for each time frame t=0, . . . , T, and T is the number of time frames within the acoustic unit.

A time warp function k(t) such that sequence vector v(t) is closest to a sequence of approximation vectors V(k(t)) for each t=0, . . . , K and a corresponding vector in the sequence vector v(t) are then determined, as indicated in step 770. Here, K is the number of vectors in the sequence vector v(t).

Next, the time warp function k(t) is "parameterized" using a first and a second straight line, as indicated in step 780. Here, the starting point for the parameterization is located such that one line extends from the point (0, 0) to (p, q) and another line extends from (p, q) to (K, T). This step is performed to approximate a curve which extends between two points in the (0, K) to (0, T) space. The parameter p, q, along with the "name" of the acoustic unit are stored, as indicated in step 790. Here, (p, q) is the time warp inclination point coordinates, where parameter p, q is the point at which the first and second straight lines intersect.

To retrieve the basis vectors x and y associated with the phonemes or allophones that are associated with a specific acoustic unit, a reconstruction of the time warp function k(t) and the sequence of approximation vectors V(k(t)) is performed. Here, x and y are based on the "label" of the unit and the parameter p, q that are stored along with the name(s) of each acoustic unit. The resultant sequence of approximation vectors V(k(t)) is then used to directly synthesize the original natural speech sequence.

The method of the invention utilizes the close acoustic matching property of acoustic units to minimize the number of parameter per acoustic unit that are stored as LPC parameters. The method of the invention compresses the acoustic parameter space by a significant factor. As a result, smaller storage devices may be used due to a reduction of the size of storage requirements.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for compressing concatenative acoustic inventories for speech synthesis, comprising:

creating an acoustic inventory comprising a plurality of natural speech intervals;

determining a set of peak components for each basis vector in the plurality of natural speech intervals;

determining start and end vectors for the plurality of natural speech intervals;

defining a mapping between a first peak index set associated with the start vector and a second peak index set associated with the end vector such that respective peak points in the first peak index set and the second peak index set are associated with each other;

creating an extended mapping based on the mapping between the first peak index set and the second peak index set;

performing a comparison between a complete morph mapping and a peak morph mapping to determine whether an index is located within the first peak index set;

creating a sequence of approximation vectors based on the complete morph mapping;

determining a time warp function and a corresponding vector in a sequence vector which is proximal to the sequence of approximation vectors;

parameterizing the time warp function by way of a first straight line and a second straight line to approximate a curve which extends through a predetermined spaced; and storing the parameters index function and names of the acoustic units.

2. The method of claim 1, further comprising the steps of:

determining a next higher index and a next lower index which are each located within the first peak index set; and performing an interpolation between peak morph mapping values to obtain the complete morph mapping.

3. The method of claim 1, wherein the plurality of natural speech intervals are sequences of vectors in a vector space.

4. The method of claim 3, wherein the vector space is an acoustic space.

5. The method of claim 3, wherein the vector space comprises a 128 point power spectra.

6. The method of claim 1, wherein the basis vectors are associated with one of phonemes and allophones in the plurality of natural speech intervals.

7. The method of claim 1, wherein the extended mapping ranges from a first parameter to a second parameter.

8. The method of claim 7, wherein the first parameter and the second parameter range from 1 to 128, respectively.

9. The method of claim 1, wherein said step of creating a sequence of approximation vectors is performed in accordance with the relationships:

$$M_t[i]=(T-t)/T*i+t/T*M(i),$$

and

V(T) whose $M_t[i]$-th component is $(T-t)/T*x[i]+t/T*y[M(i)]$.

10. The method of claim 9, where $M_t[i]$ is rounded to the nearest integer between 1 and 128, for each time frame t=0, . . . , T, and T is the number of time frames within the plurality of natural speech intervals.

11. The method of claim 1, wherein a starting point for parameterizing the time warp function is located such that one line extends from a first point to a second point and another line extends from the second point to another point.

12. The method of claim 1, wherein the speech intervals are sequences of vectors in a vector space.

13. The method of claim 12, wherein the vector space is an acoustic space.

14. The method of claim 13, wherein the vector space comprises a 128 point power spectra.

15. A system for compressing concatenative acoustic inventories for speech synthesis, comprising:

an acoustic element retrieval processor, said processor creating an acoustic inventory comprising a plurality of natural speech intervals received from an acoustic element database;

an element processing and concatenation processor; said element processor performing the steps of:

determining a set of peak components for each basis vector in the plurality of natural speech intervals;

determining start and end vectors for each basis vector in the natural speech intervals;

defining a mapping between a first peak index set associated with the start vector and a second peak index set associated with the end vector such that respective peak points in the first peak index set and the second peak index set are associated with each other;

creating an extended mapping based on the mapping between the first peak index set and the second peak index set;

performing a comparison between a complete morph mapping and a peak morph mapping to determine whether an index is located within the first peak index set;

creating a sequence of approximation vectors based on the complete morph mapping;

determining a time warp function and a corresponding vector in a sequence vector which is proximal to the sequence of approximation vectors; and parameterizing the time warp function by way of a first straight line and a second straight line to approximate a curve which extends through a predetermined spaced; and an acoustic storage device for storing the parameters index function and names of the acoustic units.

16. A method for compressing concatenative acoustic inventories for speech synthesis, comprising:

determining a set of phonemes;

determining for each phoneme a set of at least one phones, said set of at least one phones comprising at least one of phonemes which may occur as neighbors of said phoneme in a speech synthesis output and contextual descriptors;

determining an inventory specification comprising a plurality of specifications of a phone sequence which is required by a synthesis input domain;

obtaining a set of human speech recordings containing speech intervals which correspond to sequences of phones which include all phone sequences in the inventory specification;

obtaining a parametric representation of the speech intervals which are obtained such that each speech interval is represented as a trajectory through an acoustic parameter space;

for each phone, obtaining at least one basis vector in the acoustic parameter space from stored trajectories such that one of an initial and final vector of a trajectory of each speech interval is approximated by a corresponding basis vector; said speech interval having corresponding phone sequences that include a phone in one of an initial and final position;

approximating each stored trajectory by a time varying mathematical combination of basis vectors for a phone which is associated with a stored trajectory to generate approximate trajectories; and constraining the approximate trajectories such that all approximate trajectories that correspond to acoustic units which start or terminate with a given phone posses substantially identical initial or final frames.

17. The method of claim 16, wherein the textual contextual descriptors are one of lexical stress and location in a speech phrase.

18. The method of claim 16, wherein the at least one basis vector is associated with one of phonemes and allophones in the speech intervals.

* * * * *